United States Patent [19]

Palmeri

[11] Patent Number: 4,928,329

[45] Date of Patent: May 29, 1990

[54] BATHROOM ASSEMBLY FOR HANDICAPPED INDIVIDUALS

[76] Inventor: Richard P. Palmeri, 6112 E. Mockingbird La., Paradise Valley, Ariz. 85253

[21] Appl. No.: 185,461

[22] Filed: Apr. 25, 1988

[51] Int. Cl.[5] ..... A47K 4/00; A47K 3/022; A47K 3/22

[52] U.S. Cl. ..... 4/552; 4/555; 4/584; 4/604

[58] Field of Search ..... 4/538, 546, 547, 548, 4/552, 555, 559, 560, 584, 589, 590, 596, 597, 604, 607, 612–614; D23/271, 275, 277, 280–283, 304

[56] References Cited

U.S. PATENT DOCUMENTS

| | | | |
|---|---|---|---|
| D. 95,375 | 4/1935 | Morgan | 4/538 |
| D. 288,350 | 2/1987 | Diamond | D23/280 |
| 2,037,895 | 4/1936 | Gugler | 4/663 |
| 3,955,219 | 5/1976 | Finch et al. | 4/552 |
| 4,316,294 | 2/1982 | Baldwin | 4/584 |

FOREIGN PATENT DOCUMENTS

| | | | |
|---|---|---|---|
| 1294295 | 4/1969 | Fed. Rep. of Germany | 4/663 |
| 0000392 | of 1898 | United Kingdom | 4/589 |
| 1532953 | 11/1978 | United Kingdom | 4/607 |
| 2038177 | 7/1980 | United Kingdom | 4/589 |

*Primary Examiner*—Henry J. Recla
*Assistant Examiner*—J. Casimer Jacyna
*Attorney, Agent, or Firm*—Tod R. Nissle

[57] ABSTRACT

A bathroom structure. The structure enables an individual in a wheelchair to readily maneuver himself into and out of a bathtub or shower. The bathroom structure minimizes the probability that an individual will accidentally drown in the bathtub.

10 Claims, 2 Drawing Sheets

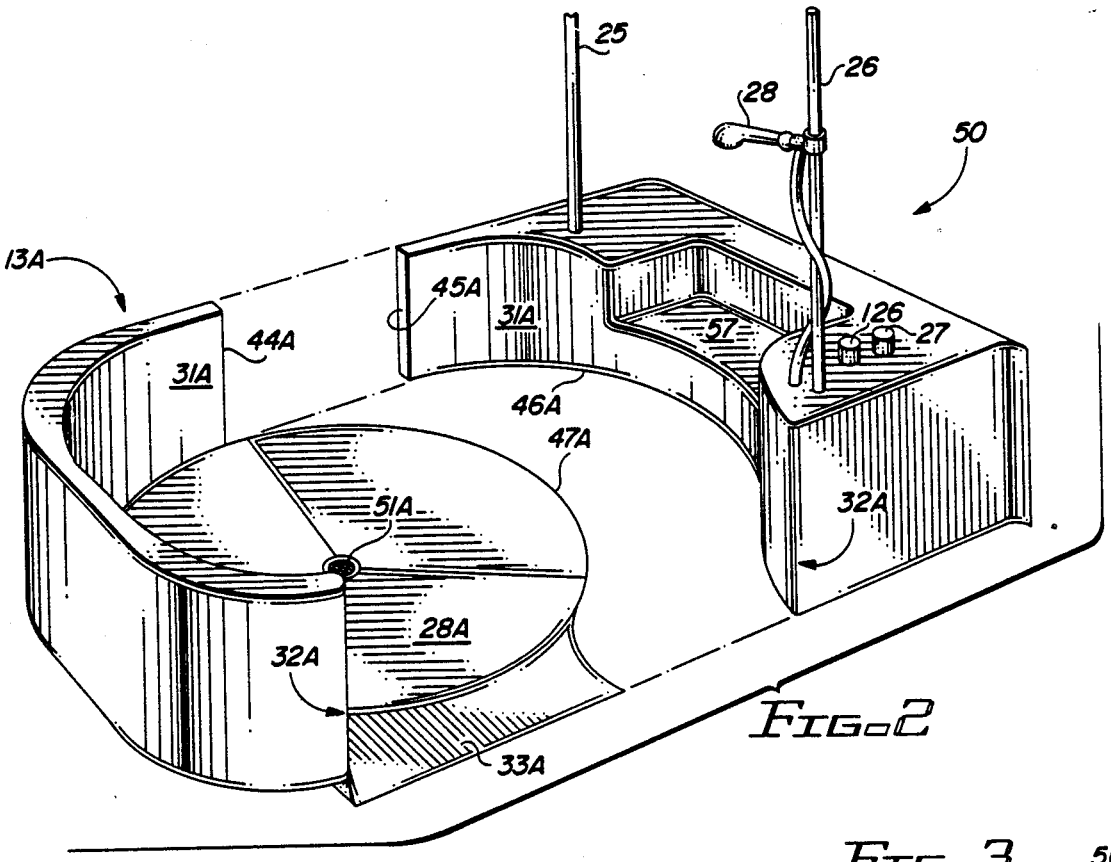
FIG. 2
FIG. 3
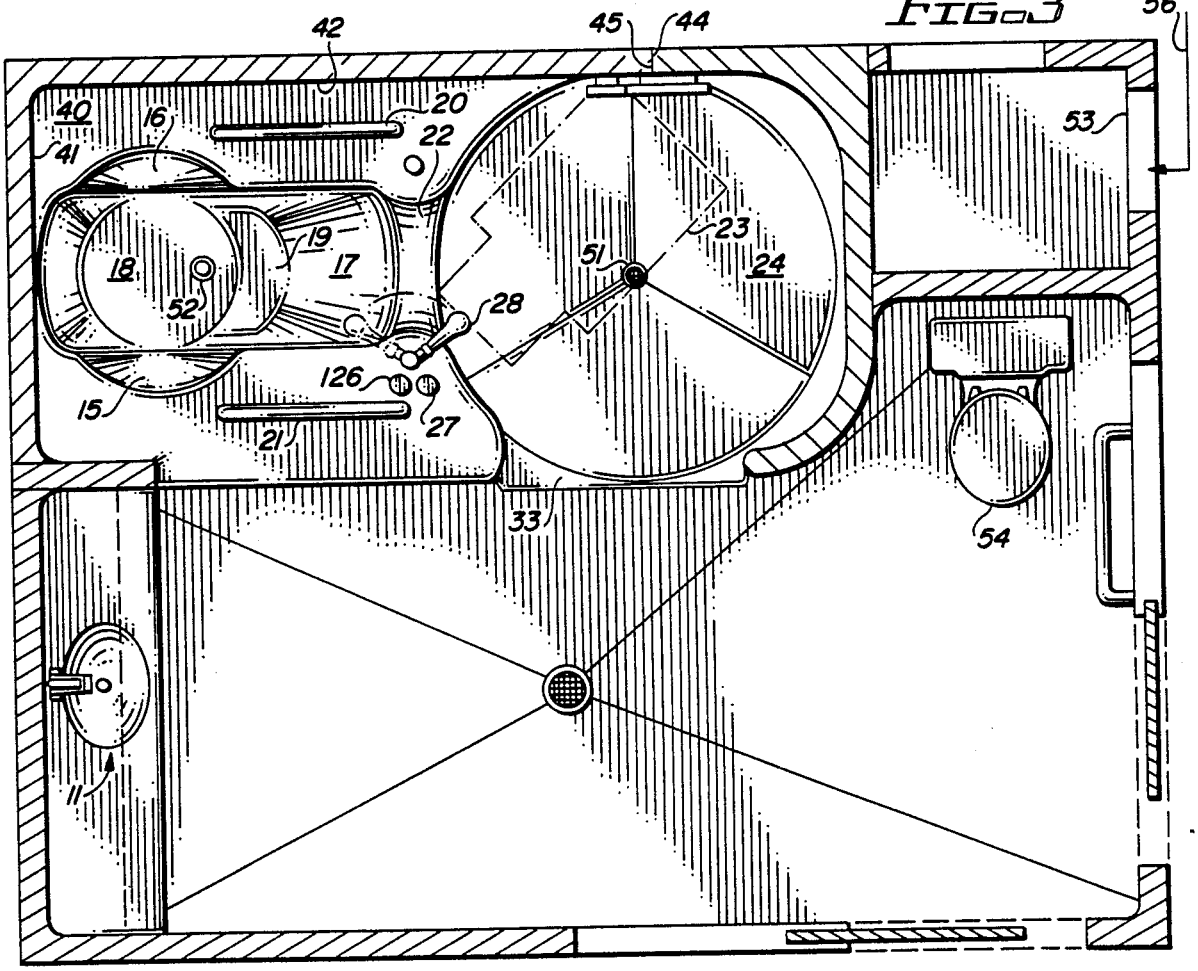

BATHROOM ASSEMBLY FOR HANDICAPPED INDIVIDUALS

BACKGROUND OF THE INVENTION

1. Field of the Invention

This invention pertains to bathroom structures.

More particularly, the invention pertains to a bathroom structure which enables a paraplegic to readily maneuver himself into and out of a bathtub or shower.

In a further respect, the invention pertains to a bathtub which minimizes the probability that a paraplegic or other individual will accidentally drown in the bathtub.

2. Description of the Related Art Including Information Disclosed Under 37 CFR §1.97 to 1.99

Conventional bathtubs and shower stalls present, even for individuals with normal physical abilities, a risk of injury in use. Each year, numerous individuals slip and fall and injure themselves before, during, or after bathing. The risks associated with bathing become markedly greater for the elderly or physically handicapped. In many cases handicapped individuals cannot bathe without the assistance of a medical attendant.

Accordingly, it would be highly desirable to provide bathing facilities which reduce the risk of injury for a handicapped individual and which minimize the instances in which handicapped individuals require the assistance of a medical attendant to bathe.

Therefore, it is a principal object of the invention to provide improved bathing facilities.

Another object of the invention is to provide improved bathing facilities which enable a paraplegic to easily and safely enter and leave a bathtub before and after bathing, and which, when the paraplegic is in the bathtub, make it difficult for a paraplegic to drown after he or she accidentally falls asleep.

A further object of the invention is to provide improved bathing facilities which enable a handicapped individual in a wheelchair to manipulate a single faucet to direct water into a shower stall or into an adjacent bathtub.

BRIEF DESCRIPTION OF THE DRAWINGS

These and other, further and more specific objects and advantages of the invention will be apparent to those skilled in the art from the following detailed description thereof, taken in conjunction with the drawings, in which:

FIG. 2 is a perspective view of a shower stall constructed in accordance with the invention; and, FIG. 3 is a top view of the bathroom of FIG. 1.

SUMMARY OF THE INVENTION

Figure 1:
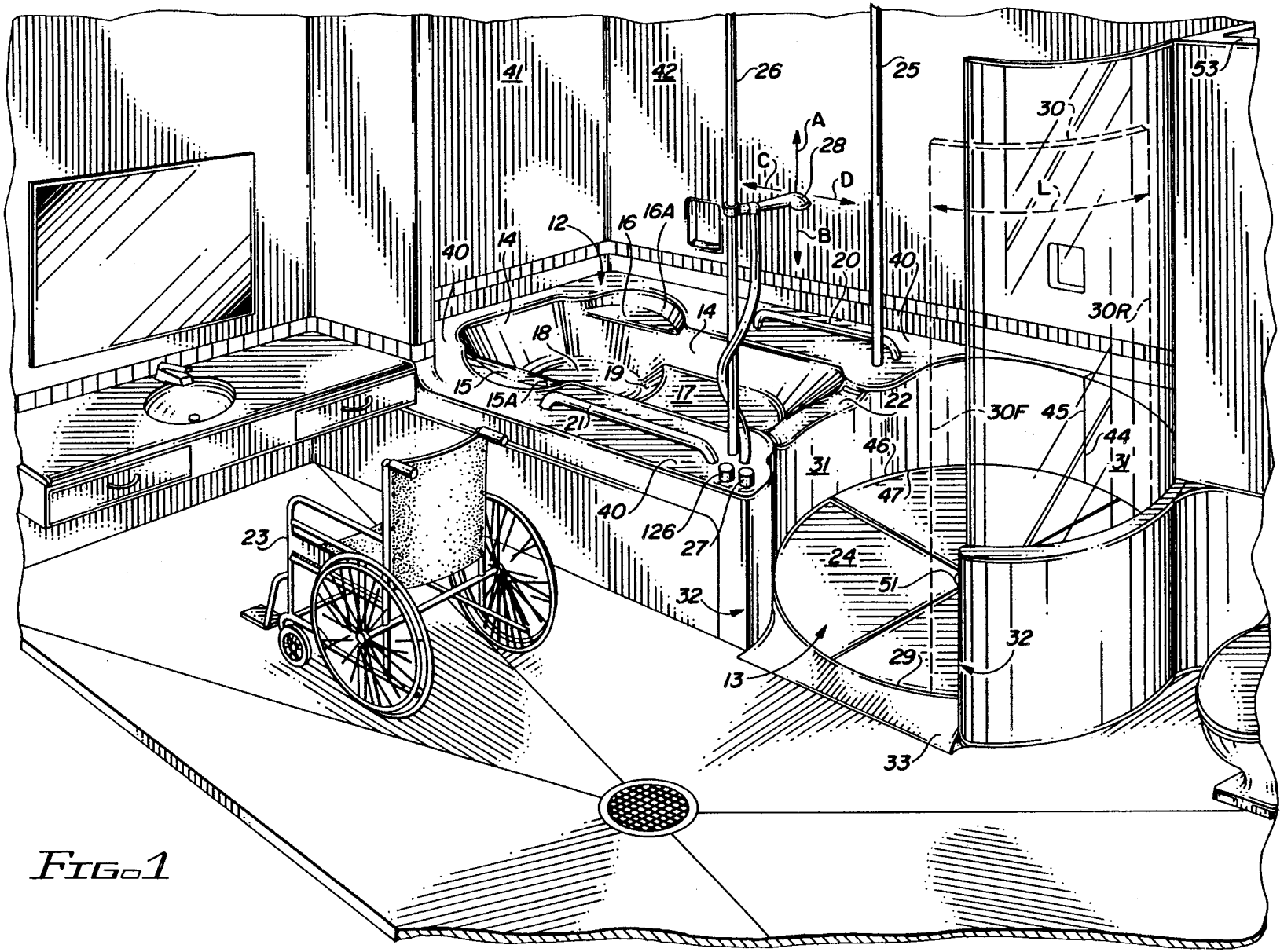
FIG. 1 is a perspective view of a bathroom constructed in accordance with the principles of the invention.

Briefly, in accordance with my invention, I provide a bathtub including a tub having a multi-level floor and a surrounding wall for holding a quantity of water, and horizontally oriented ledge surfaces terminating at end extending outwardly from the wall, the floor including a first level for supporting a bather's feet, a second level lower than the first level for a bather to sit on, and, a sloped surface interconnecting the first and second levels to support a bather's thighs when the bather is sitting on the second level with his feet on the first level, the sloped surface impeding a bather's buttocks and thighs from sliding over the floor of the tub toward the first level when the bather is sitting on the second level, the horizontally oriented ledge surface, when the bather is sitting on the second level, receiving and supporting the arms of the bather to facilitate the bather's sitting upright in the tub; ledge means extending upwardly from the horizontally oriented surfaces to permit a bather, when each of his arms is on one of the horizontally oriented ledge surfaces, to maintain each of his hands against said ledge means to counteract the bather's shoulders moving forwardly toward said first level; a surface adjacent to and exterior of the tub for a bather to position a wheelchair on; an opening in tub wall located above the first level and extending from the top of the wall downwardly a selected distance toward the floor for permitting a bather seated in a wheelchair setting on the surface to transfer himself from the wheelchair to a seated position in said opening; and, at least one hand rail means attached to and extending along the top of the wall and reachable by a bather sitting on the second level and by a bather sitting in said opening. The bathtub can include a shower stall adjacent the tub in communication with the opening and having a shower stall floor which comprises the surface; a wheelchair accessway formed in the shower stall; an arcuate groove formed in the perimeter of the surface across the accessway and extending in the surface to at least one side of the accessway; and, a free standing arcuate accessway door having a lower edge received by the groove for movement along the groove to move the door across and away from the accessway. The bathtub can also include a shower stall adjacent the tub in communication with the opening and having a shower stall floor which comprises the surface; a wheelchair accessway formed in the shower stall; a faucet having at least two operative positions, a first operative position for directing water into the tub, and a second operative position for directing water into the shower stall; and, valve means for directing water into the faucet. Means can be provided for altering the height of the faucet above the stall floor and tub floor. The accessway can include ramp means having a planar surface terminating at the shower stall floor and having a selected slope to permit the wheel of a wheelchair to roll smoothly over and on the planar surface through the accessway onto the shower stall floor.

DESCRIPTION OF THE PREFERRED EMBODIMENTS

Turning now to the drawings, which depict the presently preferred embodiments of the invention for the purpose of illustrating the practice thereof and not by way of limitation of the scope of the invention, and in which like reference characters represent corresponding elements throughout the several views, FIGS. 1 and 3 illustrate a bathroom constructed in accordance with the invention and including sink 11, bathtub 12 and shower stall 13. Bathtub 12 includes a multi-level floor surrounded by a wall 14. A pair of spaced apart horizontally oriented ledge surfaces are formed on either side of tub 12. Each ledge surface 15, 16 terminates at and extends outwardly from wall 14. The floor of the tub includes a first level 17 for supporting the feet of a bather and a second level 18 for a bather to sit on. Sloped surface 19 interconnects first 17 and second 18 levels to support a bather's thighs when the bather is sitting on the second level 18 with his feet on the first level 17. Sloped surface 19 impedes and prevents a bather's buttocks and thighs from readily sliding over the tub floor toward the first level 17 when the bather is sitting on the second level 18. A bather can, by grasping one of hand rails 20, 21 with each hand, pull his buttocks up surface 19 onto level 17 and onto opening 22 formed in the tub wall above level 17. Opening 22 extends from the top of wall 14 downwardly a selected distance toward floor 17. When a wheelchair 23 is positioned on the floor 24 of shower stall 13, an individual can move from the seat of the wheelchair 23 to a seated position in opening 22. To facilitate movement from the wheelchair 23 to opening 22, the individual can grasp vertical poles 25 and 26 and/or hand rails 20 and 21. Horizontally oriented ledge surfaces 15 and 16 receive and support the arms of a bather to facilitate the bather's sitting upright in tub 11. Surfaces 15 and 16 support the forearms, which are normally bent at an angle to the upper arm, and a lower portion of the upper arms. A bather sitting on level 18 with his forearms resting on surfaces 15 and 16, respectively, can place the heels of the palms of his hands against the forward portions, i.e. the portions nearest level 17, of ledges 15A and 16A, respectively. When the bather rests the palms of his hands against ledges 15A and 16A this prevents the shoulders of the bather from moving forward toward level 17. Consequently, ledges 15A and 16A and sloped surface 19 together enable a bather to remain in an upright seated position in tub 12 with little, if any, physical exertion, and prevent a bather's buttocks from sliding toward level 17, even if the bather falls asleep. Further, even if the bather's hands are resting on surface 18 at the bather's sides, surface 19 supports the upper legs of the bather and acts to prevent the bather's buttocks from readily sliding over surface 19 onto level 17. Knobs 126 and 27 control the flow of water to faucet 28 attached to pole 26. Means are provided which enable the elevation of faucet 28 to be adjusted in the directions indicated by arrows A and B. The faucet 28 can be rotated about pole 26 in the directions indicated by arrows C and D so faucet 28 can direct water into stall 13 or tub 12. Control knobs 126 and 27 can be operated by an individual seated in a wheelchair when the wheelchair is positioned adjacent tub 12 or is positioned in stall 13 adjacent ledge 22.

Circular groove or channel 29 formed in floor 24 receives a free standing arcuate shower door illustrated in FIG. 1 by dashed lines 30 for purposes of clarity. The arcuate length L of door 30 is greater than a distance equal to one-fourth of the circumference of floor 24. When the arcuate length L of door 30 is greater than one-fourth the circumference of floor 24, door 30 cannot fall inwardly because it contacts wall 31 of the shower. A bather seated in a wheelchair which is in stall 13 on floor 24 can push or pull door 30 by grasping the forward 30F or rear 30R edge of door 30. The bottom edge of door 30 has rollers (not visible) which roll along groove 29 to enable door 30 to be pushed across and away from the accessway 32 formed in stall 13 to receive wheelchair 23. Ramp 33 terminates at floor 24 and enables the wheels of wheelchair 23 to roll smoothly over and on ramp 33 through accessway 32 onto floor 24. Floor 24 is sized to permit a wheelchair in stall 13 to be moved in a circle on floor 24 either in one continuous movement or in a series of "turn-and-backup" movements.

In FIG. 1, a horizontal ledge 40 partially circumscribes tub 12. Walls 41 and 42 can extend upwardly from ledge 40, and can extend past ledge 40 down to floor level. When wall 41 and 42 extend down to floor level, tub 12 is a free standing unit which is pushed against walls 41 and 42 to the position shown in FIG. 1. The portion of the shower stall in FIG. 1 is also free standing. The free standing shower stall portion is shown in FIG. 2.

In FIG. 2, arcuate edge 47A abuts and conforms to arcuate surface 46A of seat assembly 50. Upstanding vertical edge 44A abuts with edge 45A of seat assembly 50. The shower stall 13 in FIG. 1 is a mirror image of the stall 13A in FIG. 2. Seat 57 is formed in seat assembly 50.

In FIGS. 1 and 3, a single pipe line leads from sink 11 to the drain of the tub 12 and to the drain 51 of shower stall 13. The drain 51 is lower than drain 52 which is lower than the sink 11 drain. A pipe (not visible) leads from drain 51 to a sump in the bottom of chamber 53. The sump is connected to a city sewer line. Accordingly, all waste water flowing through the drain of sing 11, through drain 52 and through drain 51 flows into a single conduit leading to the sump in container 53.

The sink, tub and shower stall all drain into a single waste pipe or into a pipe network which leads to a sump in the bottom of chamber 53. Drain 51 is higher than the sump. Further, hot and cold inlet water pipes ending at chamber 53 extend to faucet knobs 126 and 27 and then extend to sink 11. A cold water pipe attached to the cold water pipe extending from chamber 53 to knobs 126 and 27 leads to the toilet 54. Accordingly, if the bathroom of FIGS. 1 and 3 either is made as a unitary prefabricated assembly, or is made in modular portions which are assembled to form the bathroom, all plumbing connections 55 are made at chamber 53. There are only three plumbing connections which are made, one for hot water, one for cold water, and one for waste water. The waste water connection attaches to the sump in chamber 53 and leads to a sewer line or other waste disposal system. The hot and cold water inlet pipes and the waste pipe or pipes are concealed beneath the sink, bathtub, floor, etc. in conventional fashion. As a result, installation of the bathroom of the invention is a simple matter which eliminates many of the manhours normally required to install a bathroom in a residence.

While the bathroom of the invention can be produced from a variety of materials, it is anticipated that the sink, tub toilet and most other structural members of the bathroom of the invention will be fabricated from fiberglass or cast acrylic. In order to facilitate use of the shower and bathtub shown in FIGS. 1 to 3, I have discovered a wheelchair which is fabricated from fiberglass or cast acrylic. The wheelchair is impervious to the corrosive affects of water and has large side wheels having outer rims which at all times are lower than the seat of the wheelchair. When the entire diameter of the large side wheels are beneath the seat of the wheelchair, movement from the wheelchair seat to ledge 22 is facilitated. If a conventional wheelchair is positioned adjacent ledge 22, the individual in the wheelchair can move from the seat of the wheelchair to ledge 22, but the portion of the side wheel of the wheelchair which is intermediate the wheelchair seat and ledge 22 interferes with smooth movement from the wheelchair to the ledge 22.

Door 30 is preferably immediately adjacent cylindrical wall 31. This helps prevent door 30 from falling outwardly away from the shower stall. The arcuate lower edge of door 30 and the wheels on the bottom edge of door 30 in groove 29 help prevent door 30 from tipping inwardly or outwardly into the stall 13.

Having described my invention in such terms as to enable those skilled in the art to understand and practice it, and having identified the presently preferred embodiments thereof, I claim:

1. A bathtub including (a) a tub having a multi-level floor and a surrounding wall having an interior portion for holding a quantity of water and a top portion extending substantially horizontally outwardly from said interior portion, said floor including (i) a first level for supporting a bather's feet, (ii) a second level lower than said first level for a bather to sit on, and, (iii) a sloped surface interconnecting said first and second levels to support a bather's thighs when the bather is sitting on said second level with his feet on said first level, said sloped surface impeding a bather's buttocks and thighs from sliding over said floor of the tub toward said first level when the bather is sitting on said second level;

(b) a support surface abutting adjacent to and extending away from said tub for a bather to position a wheelchair on;

(c) an opening in said tub wall located above said first level and said support surface and extending from the top portion of said wall downwardly a selected distance toward said first level for permitting a bather seated in a wheelchair setting on said support surface to transfer himself from said wheelchair to a seated position in said opening;

(d) at least one hand rail means attached to and extending along the top portion of said wall and reachable by a bather sitting on said second level and by a bather sitting on said ledge means;

(e) a shower stall adjacent said tub and having access opening means in communication with said opening and having a shower stall floor which comprises said support surface;

(f) a wheelchair accessway formed in said shower stall;

(g) a faucet means mounted with respect to said tub and shower stall to have at least two operative positions, (i) a first operative position for directing water into said tub, and (ii) a second operative position for directing water into said shower stall, and, (h) valve means for directing water into said faucet; said valve means being positioned to be reached and operated by an individual seated in (i) a wheel chair outside of said tub and said shower stall without the bather having to reach out over said floor or said support surface to operate said valve means;

(j) a wheel chair inside of said shower stall;

(k) said opening in said tub wall; and, (l) said tub.

2. The bathtub of claim 1 including means for altering the height of said faucet means above said stall floor and tub floor.

3. The bathtub of claim 2 wherein said faucet is positioned at an elevation for movement between said first and second operative positions by a bather seated in (a) a wheel chair outside of said tub and shower stall without the bather having to reach out over said floor or said support surface to move said faucet;

(b) a wheel chair inside of said shower stall;

(c) said opening in said tub wall; and, (d) said tub.

4. The bathtub of claim 2 wherein said hand rail means extends to a position adjacent said valve means to permit an individual to grasp said hand rail means with one hand while operating said valve means with the other hand.

5. The bathtub of claim 1 wherein said shower stall is a modular free standing unit.

6. A bathtub including (a) a tub having a floor and a surrounding wall for holding a quantity of water, said wall having a top portion;

(b) a support surface abutting adjacent to and extending away from said tub for a bather to position a wheelchair on;

(c) an opening in said tub wall located above said first level and said support surface and extending from the top portion of said wall downwardly a selected distance toward said floor for permitting a bather seated in a wheelchair setting on said support surface to transfer himself from said wheelchair to a seated position in said opening;

(d) a shower stall adjacent said tub and having access opening means in communication with said opening and having a shower stall floor which comprises said support surface;

(e) a wheelchair accessway formed in said shower stall;

(f) a faucet means mounted with respect to said tub and shower stall to have at least two operative positions, (i) a first operative position for directing water into said tub, and (ii) a second operator position for directing water into said shower stall, and, (g) valve means for directing water into said faucet; said valve means being positioned to be reached and operated by a bather seated in (h) a wheel chair outside of said tub and said shower stall without having to reach out over said floor or said support surface to operate said valve means;

(i) a wheel chair inside of said shower stall;

(j) said opening in said tub wall; and, (k) said tub.

7. The bathtub of claim 6 including means for altering the height of said faucet means above said stall floor and tub floor.

8. The bathtub of claim 7 wherein said faucet is positioned at an elevation for movement between said first and second operative positions by an individual seated in (a) a wheel chair outside of said tub and shower stall;

(b) a wheel chair inside of said shower stall;

(c) said opening in said tub wall; and, (d) said tub.

9. The bathtub of claim 8 including hand rail means adjacent said valve means to permit a pg,23 bather to grasp said hand rail means with one hand while operating said valve means with the other hand.

10. The bathtub of claim 6 wherein said shower stall is a modular free standing unit.

* * * * *